US010907932B2

(12) United States Patent
Curry

(10) Patent No.: US 10,907,932 B2
(45) Date of Patent: Feb. 2, 2021

(54) REFLEX SIGHT

(71) Applicant: Smith & Wesson Inc., Springfield, MA (US)

(72) Inventor: Brett Curry, Monson, MA (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

(21) Appl. No.: 16/715,410

(22) Filed: Dec. 16, 2019

(65) Prior Publication Data

US 2020/0200507 A1 Jun. 25, 2020

Related U.S. Application Data

(60) Provisional application No. 62/782,420, filed on Dec. 20, 2018.

(51) Int. Cl.
*F41G 1/30* (2006.01)

(52) U.S. Cl.
CPC ..... *F41G 1/30* (2013.01)

(58) Field of Classification Search
CPC ..... F41G 1/30
USPC ..... 42/113
See application file for complete search history.

(56) References Cited

U.S. PATENT DOCUMENTS 1,602,116 A * 10/1926 Manahan ..... F41G 1/14 42/125
2,596,522 A * 5/1952 Bethke ..... F41G 1/30 42/113
D612,006 S 3/2010 Kohler
7,814,669 B2 * 10/2010 Kingsbury ..... F41G 1/345 33/265
7,921,591 B1 * 4/2011 Adcock ..... F41G 1/14 42/113
8,006,395 B2 * 8/2011 Kingsbury ..... F41G 1/345 33/265
8,151,510 B2 * 4/2012 Capson ..... F41G 1/08 42/130
8,966,805 B2 3/2015 Koesler et al.
9,057,584 B2 6/2015 Chung
9,335,124 B2 5/2016 Mayfield et al.
9,423,212 B2 * 8/2016 Campean ..... F41G 1/02
9,557,141 B2 * 1/2017 Capson ..... F41G 1/345
9,696,114 B1 * 7/2017 Cabrera ..... F41G 1/17
9,823,044 B1 * 11/2017 Cabrera ..... F41G 1/10
9,915,502 B2 3/2018 Capson
9,958,234 B2 * 5/2018 Campean ..... F41G 1/02
(Continued)

FOREIGN PATENT DOCUMENTS

EP 0086764 8/1983

*Primary Examiner* — Samir Abdosh
(74) *Attorney, Agent, or Firm* — John A. Chionchio, Esq.; Ballard Spahr LLP

(57) ABSTRACT

A reflex sight for a firearm has an optical element received within a receptacle of a housing. The housing is mounted on the firearm. Shoulders extending from a base of the optical element engage corresponding shoulders extending from the housing into the receptacle to position the optical element so that it intersects a line of sight parallel to but offset from the firing axis of the firearm. The optical element includes a collimating reflector which produces a virtual reticle visible when viewed along the line of sight when aiming the firearm. The optical element is captured within the receptacle between the firearm or a plate and the shoulders of the housing.

28 Claims, 4 Drawing Sheets

(56) References Cited

U.S. PATENT DOCUMENTS

| | | | | |
|---|---|---|---|---|
| 10,086,527 | B2 * | 10/2018 | Teetzel | F41G 1/30 |
| 10,101,121 | B2 * | 10/2018 | Cabrera | F41G 1/10 |
| 2009/0139100 | A1 * | 6/2009 | Kingsbury | F41G 1/467 33/265 |
| 2012/0151816 | A1 * | 6/2012 | Kleck | F41G 1/30 42/132 |
| 2014/0109456 | A1 * | 4/2014 | Jung | F41G 1/30 42/113 |
| 2014/0305022 | A1 * | 10/2014 | Chung | F41G 1/32 42/113 |
| 2015/0198415 | A1 * | 7/2015 | Campean | F41G 1/30 42/137 |
| 2016/0102943 | A1 * | 4/2016 | Teetzel | B27B 5/36 42/113 |
| 2016/0290765 | A1 | 10/2016 | Maryfield et al. | |
| 2016/0327366 | A1 * | 11/2016 | Campean | F41G 1/02 |
| 2017/0341257 | A1 * | 11/2017 | Teetzel | B27B 5/36 |
| 2018/0224652 | A1 | 8/2018 | Havens et al. | |

* cited by examiner

REFLEX SIGHT

CROSS REFERENCE TO RELATED APPLICATIONS

This application is based upon and claims benefit of priority to U.S. Provisional Application No. 62/782,420, filed Dec. 20, 2018, which application is hereby incorporated by reference herein.

FIELD OF THE INVENTION

The invention concerns reflex sights for firearms.

BACKGROUND

Reflex sights provide various advantages over "iron" sights of firearms. For example, reflex sights are easier to use, allow faster target acquisition, and two-eyed shooting for greater depth perception and full field of view. However, the optical elements of modern reflex sights are relatively delicate and subject to damage. Furthermore, they require a light source and a power supply to operate. There are clear opportunities to improve modern reflex sights with respect to robustness of design.

SUMMARY

The invention concerns reflex sights for firearms having a firing axis. In an example embodiment the reflex sight comprises a housing mountable or mounted on the firearm. The housing defines a line of sight parallel to the firing axis. A receptacle is positioned within the housing underlying the line of sight. An optical element comprising a reflector is attached to a base. The base is received within the receptacle such that the reflector intersects the line of sight.

An example reflex sight according to the invention may further comprise a hood mounted on the housing. The hood surrounds at least a portion of the reflector.

In an example embodiment the housing comprises a first shoulder projecting transversely to a plane of the reflector within the receptacle. The base comprises a second shoulder projecting transversely to the plane of the reflector. The first and second shoulders engage one another when the optical element is positioned within the receptacle. By way of example the housing may further comprise a bottom plate covering at least a portion of an opening providing access to the receptacle.

In an example embodiment the reflector has indicia on a surface thereof. In a specific example the indicia comprise a sight reticle which simulates a notch sight.

In an example embodiment the reflector comprises a collimating mirror. A projector, located within the housing, projects an image onto the reflector. In a particular example embodiment the image comprises a virtual reticle, for example, a dot. The projector may comprise a light emitting diode. The optical element is removable from the receptacle and also adjustably positionable relatively to the line of sight.

DETAILED DESCRIPTION

Figure 1:
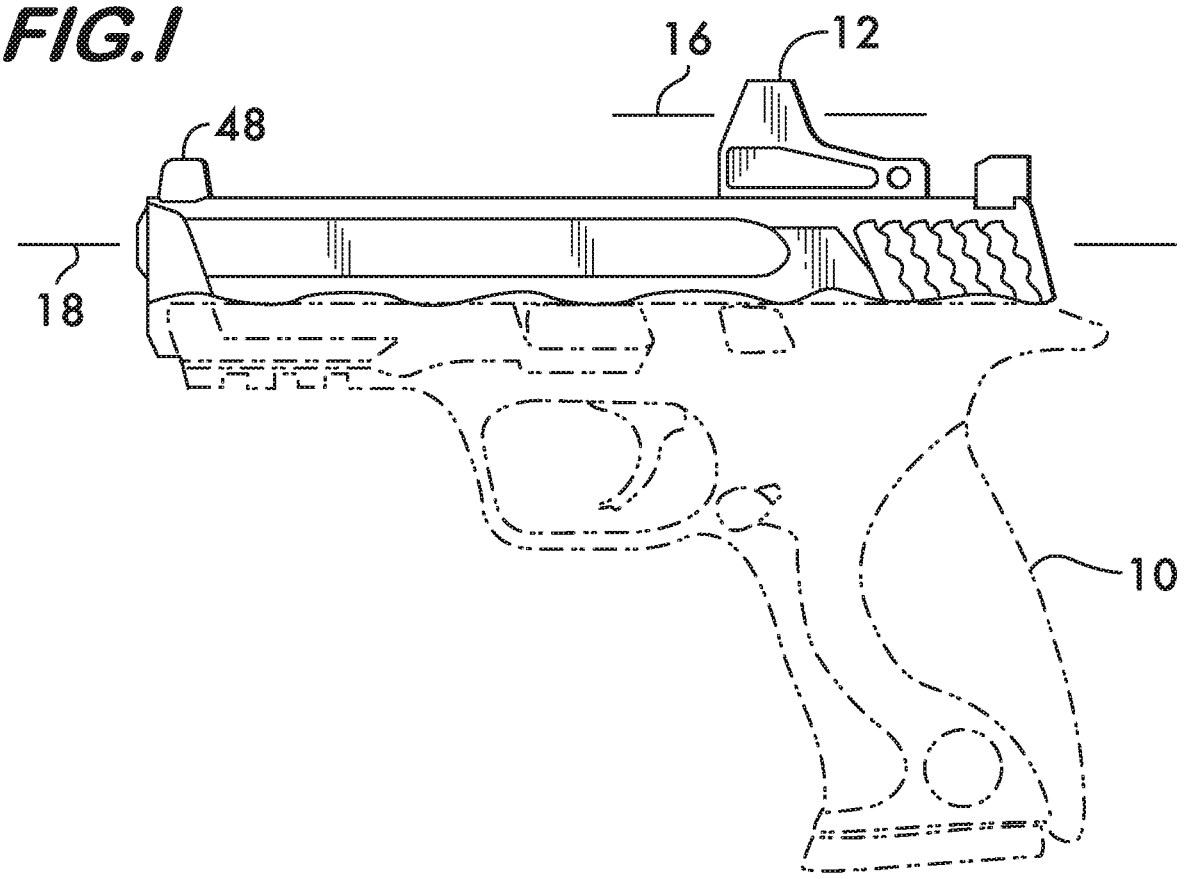
FIG. 1 is a side view of a firearm having an example reflex sight according to the invention.
Figure 2:
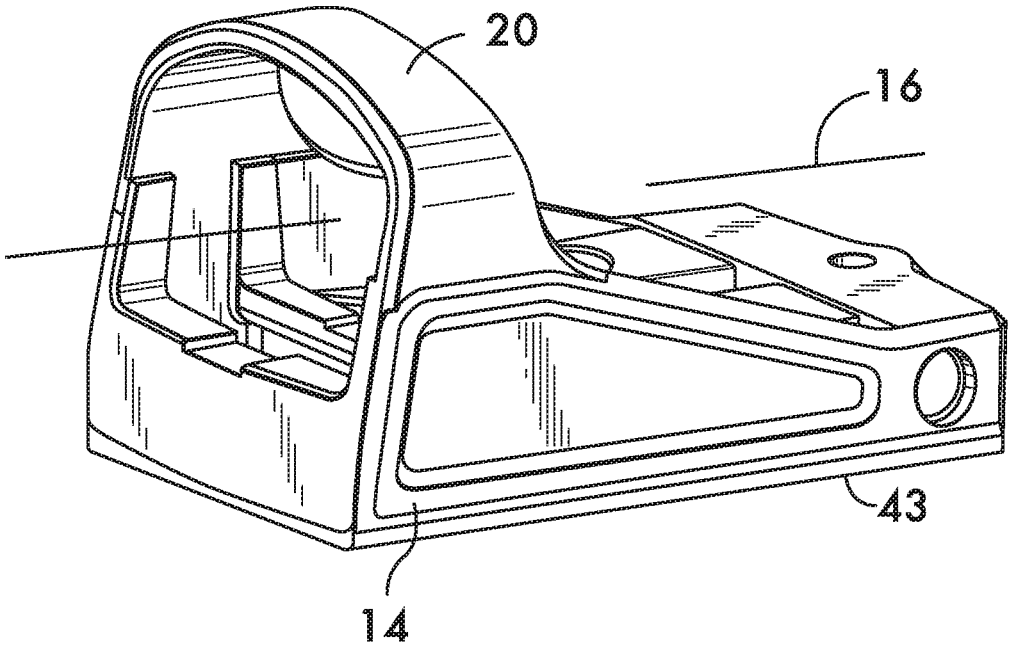
FIGS. 2 and 3 are isometric views of a part of the reflex sight shown in FIG. 1.
Figure 3:
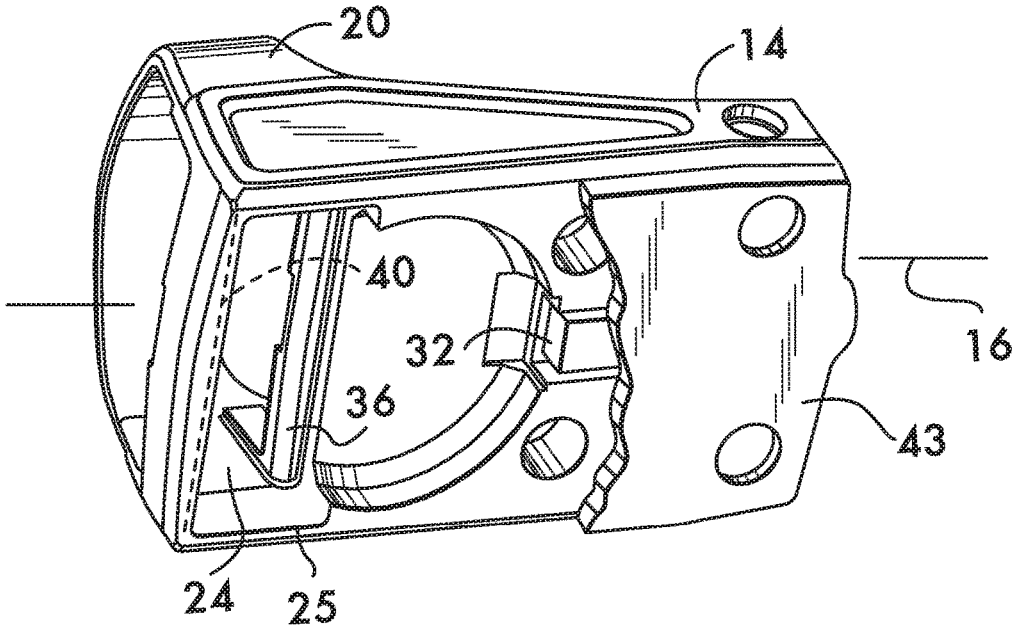
Figure 9:
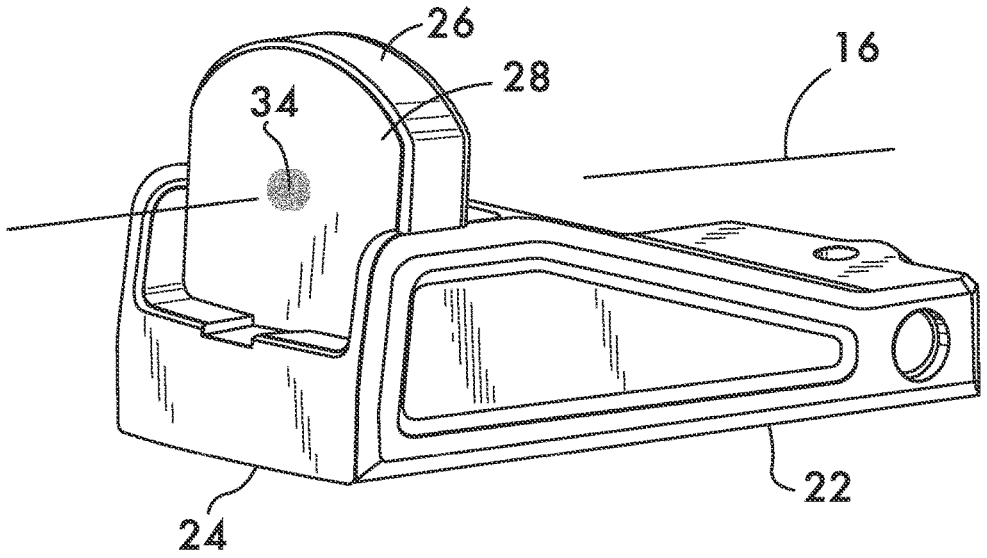
FIGS. 9 and 10 are isometric views of another example embodiment of a reflex sight according to the invention.
Figure 10:
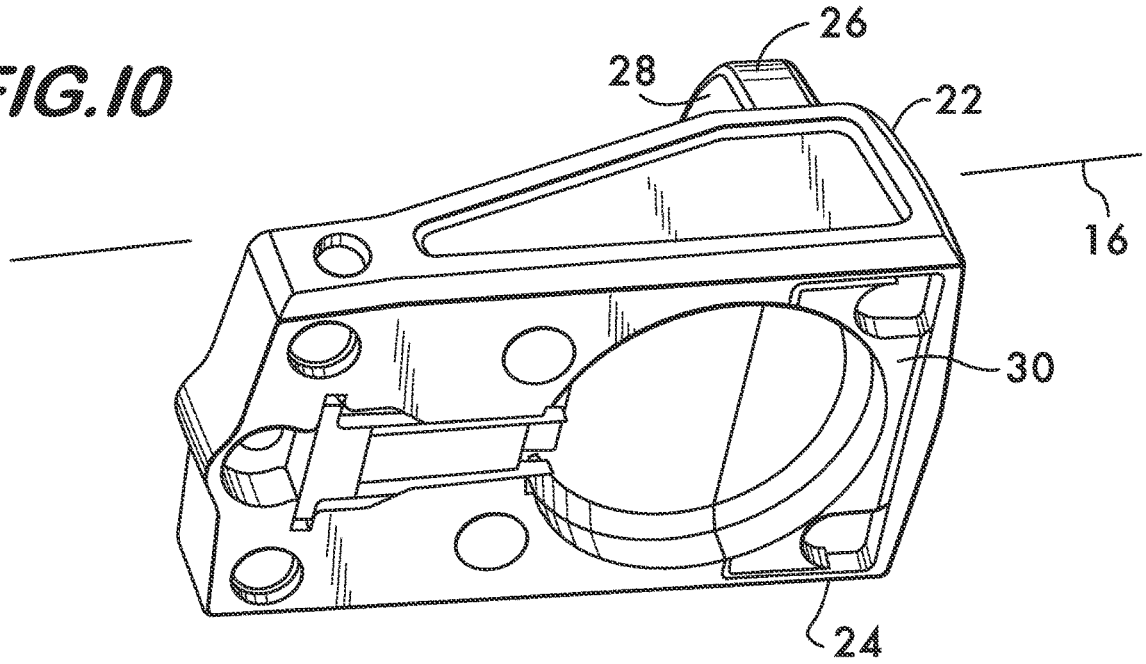

FIG. 1 shows a firearm 10 on which an example embodiment of a reflex sight 12 according to the invention is mounted. As shown in FIGS. 2 and 3, the reflex sight 12 comprises a housing 14 which defines a line of sight 16. Line of sight 16 is parallel to and offset from the firing axis 18 of the firearm 10 (see FIG. 1). Housing 14 also comprises a hood 20 which encompasses the line of sight 16. Another example housing embodiment 22, shown in FIGS. 9 and 10, is hoodless and provides a less obstructed view of peripheral objects to the down range target when in use.

Figure 4:
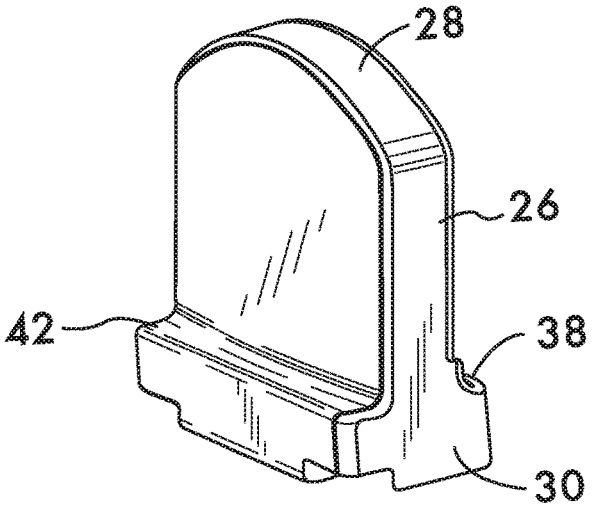
FIG. 4 is an isometric views of a part of the reflex sight shown in FIG. 1.

As shown in FIG. 3, a receptacle 24 is positioned within the housing 14 underlying the line of sight 16. Receptacle 24 has an opening 25 which provides access to the receptacle and faces the firearm 10 when housing 14 is mounted thereon. Receptacle 24 receives an optical element 26, shown in FIG. 4. Optical element comprises a reflector 28 attached to a base 30. By way of example, the reflector may be a collimating mirror, partially silvered with multilayer dielectric dichroic coatings designed to reflect light of a particular wavelength, for example, in the red portion of the spectrum (e.g., 670 nanometers) or the green portion (e.g., 530 nanometers), thereby allowing the reflector to pass light of other wavelengths along the line of sight 16. Reflector 28 works in conjunction with a projector 32 (see FIG. 3), located within the housing 14. In this example the projector comprises a light emitting diode (LED) tuned to emit light at the reflected wavelength. The LED, in conjunction with focusing lenses if necessary, projects an image 34 onto the reflector 28 (see FIGS. 5 and 6). The image reflects back to the eye of the shooter in a collimated beam and appears superimposed on the line of sight 16 thereby forming a virtual reticle such as a "red dot", which may be used to sight the firearm. Housing 14 may also contain a battery to power the projector 32.

Figure 5:
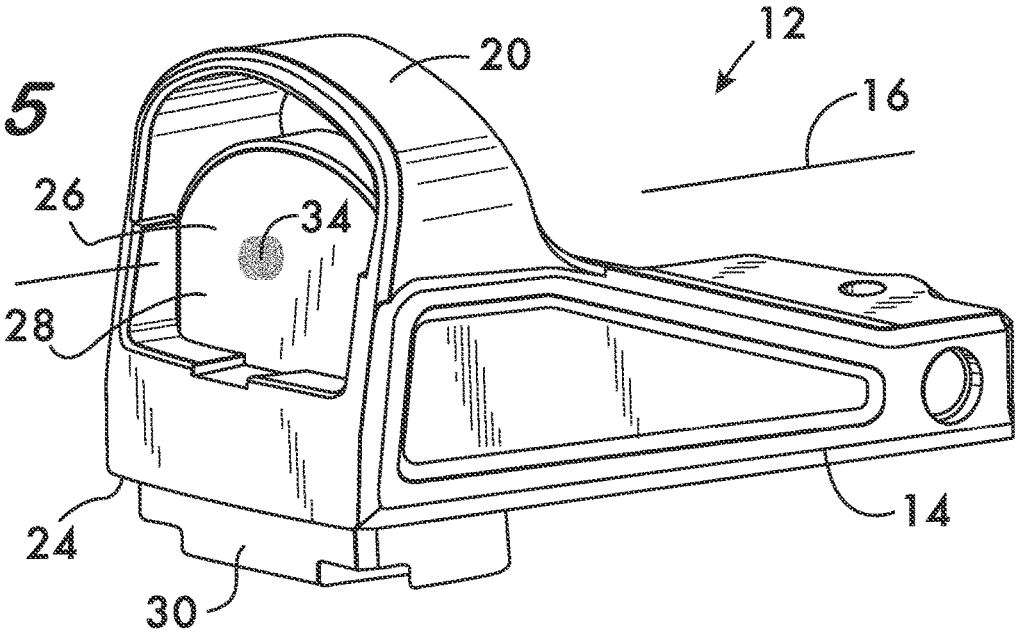
FIG. 5 is an isometric view of the reflex sight shown in FIG. 1.

As shown in FIG. 3, the housing 14 comprises at least a first shoulder 36 projecting transversely to the plane of the reflector 28 into the receptacle 24. As further shown in FIG. 4, base 30 of optical element 26 comprises at least a second shoulder 38 also projecting transversely to the plane of the reflector 28. When the optical element 28 is received within the receptacle 24 the first and second shoulders engage one another to secure the optical element within the housing 14. Additional stability to the mounting may be provided by additional shoulders 40 and 42 on both the housing 14 and the base 30 respectively. The optical element 26 may be captured within the housing 14 between the housing shoulders 36 and 40 and a bottom plate 43 attached to the housing and covering at least a portion of opening 25. In another example embodiment, the optical element 26 may be captured between the shoulders 40 and 42 and the portion of the firearm to which the housing is attached. Attachment of the housing to the firearm may be effected by threaded fasteners (not shown). As shown in FIGS. 5 and 9, when the optical element 26 is received within the receptacle 24 the reflector 28 intersects the line of sight 16. FIG. 5 shows the example embodiment of housing 14 having the hood 20 which surrounds at least a portion of the reflector 28, and FIG. 9 shows the hoodless housing 22.

Figure 6:
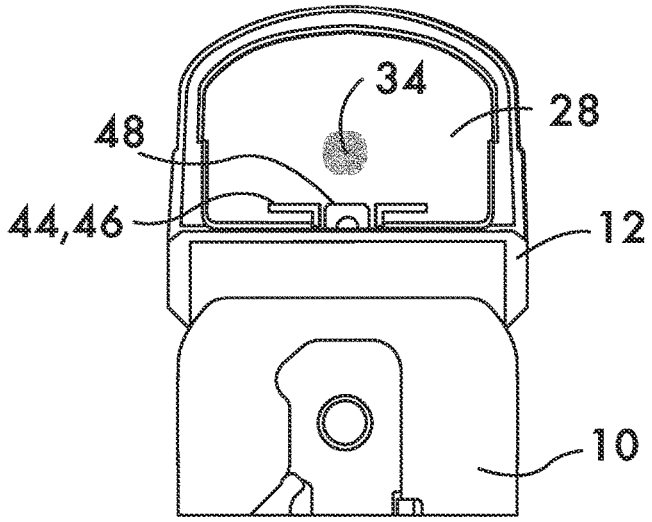
FIG. 6 is an end view of the reflex sight mounted on a firearm and looking down the firing axis.
Figure 7:
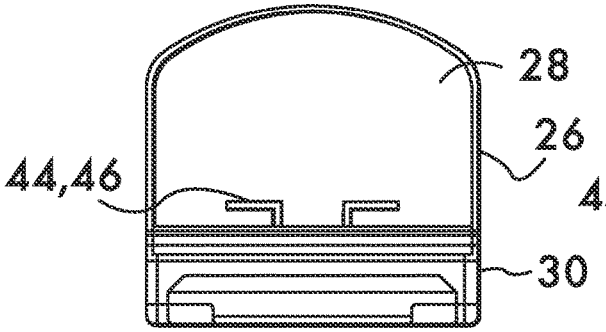
FIGS. 7 and 8 are front views of a part of the reflex sight.
Figure 8:
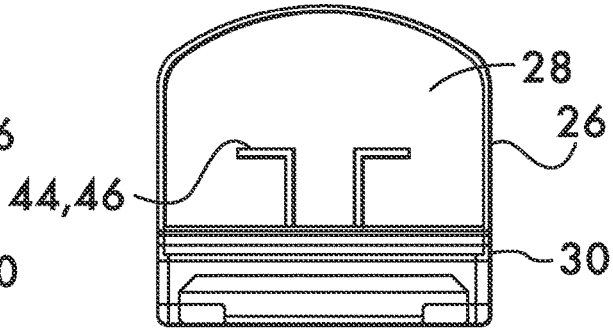

As shown in FIGS. 6, 7 and 8, the reflector 28 may have indicia 44 on a surface thereof. The indicia may be etched, printed, engraved or otherwise permanently applied and are always visible in ambient light. In this example the indicia comprise a sight reticle 46 which simulates a notch sight and allows the shooter to co-witness the virtual reticle 34 (red dot, for example) of the reflex sight 12 with the sight reticle 46 and the "iron" sights of the firearm, or use the sight reticle 46 with the front sight 48 of the firearm if the virtual reticle is not available as shown in FIG. 6. Other indicia, for example, for range estimation, may also be used on the reflector 28. As the optical element 26 is readily removable from the receptacle 24 and thus easily changeable. A shooter may have multiple optical elements with different indicia for different uses, or may change out a damaged optical element. The position of the optical element 26 may also be adjusted relative to the line of sight 16 to permit co-witnessing of both the virtual reticle 34 and the sight reticle 46. The example shown in FIGS. 7 and 8 show notch sights of different height; the higher notch being used, for example, if a suppressor is mounted on the firearm.

What is claimed is:

1. A reflex sight for a firearm having a firing axis, said reflex sight comprising:
- a housing mountable on said firearm, said housing defining a line of sight parallel to said firing axis;
- a receptacle positioned within said housing underlying said line of sight;
- an optical element comprising a reflector attached to a base, said base being received within said receptacle such that said reflector intersects said line of sight; wherein
- said housing comprises a first shoulder projecting transversely to a plane of said reflector within said receptacle; and
- said base comprises a second shoulder projecting transversely to said plane of said reflector, said first and second shoulders engaging one another when said optical element is positioned within said receptacle.

2. The reflex sight according to claim 1, wherein said optical element is removable from said receptacle.

3. The reflex sight according to claim 1, wherein said optical element is adjustably positionable relatively to said line of sight.

4. The reflex sight according to claim 1, further comprising a hood mounted on said housing, said hood surrounding at least a portion of said reflector.

5. The reflex sight according to claim 1, wherein said housing further comprises a bottom plate covering at least a portion of an opening providing access to said receptacle.

6. The reflex sight according to claim 1, wherein said reflector has indicia on a surface thereof.

7. The reflex sight according to claim 6, wherein said indicia comprise a sight reticle.

8. The reflex sight according to claim 7, wherein said sight reticle simulates a notch sight.

9. The reflex sight according to claim 1, wherein said reflector comprises a collimating mirror.

10. The reflex sight according to claim 1, further comprising a projector located within said housing, said projector projecting an image onto said reflector.

11. The reflex sight according to claim 10, wherein said image comprises a virtual reticle.

12. The reflex sight according to claim 11, wherein said virtual reticle comprises a dot.

13. The reflex sight according to claim 10, wherein said projector comprises a light emitting diode.

14. A firearm having a firing axis, said firearm comprising:
- a reflex sight, said reflex sight comprising:
- a housing mounted on said firearm, said housing defining a line of sight parallel to said firing axis;
- a receptacle positioned within said housing underlying said line of sight, said receptacle having an opening facing said firearm;
- an optical element comprising a reflector attached to a base, said base being received within said receptacle such that said reflector intersects said line of sight; wherein
- said housing comprises a first shoulder projecting transversely to a plane of said reflector within said receptacle; and
- said base comprises a second shoulder projecting transversely to said plane of said reflector, said first and second shoulders engaging one another when said optical element is positioned within said receptacle.

15. The firearm according to claim 14, wherein said optical element is removable from said receptacle.

16. The firearm according to claim 14, wherein said optical element is adjustably positionable relatively to said line of sight.

17. The firearm according to claim 14, wherein said reflex sight further comprises a hood mounted on said housing, said hood surrounding at least a portion of said reflector.

18. The firearm according to claim 14, wherein said housing further comprises a bottom plate covering at least a portion of an opening providing access to said receptacle.

19. The firearm according to claim 14, wherein said reflector has indicia on a surface thereof.

20. The firearm according to claim 19, wherein said indicia comprise a sight reticle.

21. The firearm according to claim 20, wherein said sight reticle simulates a notch sight.

22. The firearm according to claim 14, wherein said reflector comprises a collimating mirror.

23. The firearm according to claim 14, further comprising a projector located within said housing, said projector projecting an image onto said reflector.

24. The firearm according to claim 23, wherein said image comprises a virtual reticle.

25. The firearm according to claim 24, wherein said virtual reticle comprises a dot.

26. The firearm according to claim 23, wherein said projector comprises a light emitting diode.

27. A reflex sight for a firearm having a firing axis, said reflex sight comprising:
- a housing mountable on said firearm, said housing defining a line of sight parallel to said firing axis;
- a receptacle positioned within said housing underlying said line of sight;
- a bottom plate covering at least a portion of an opening providing access to said receptacle;
- an optical element comprising a reflector attached to a base, said base being received within said receptacle such that said reflector intersects said line of sight.

28. A firearm having a firing axis, said firearm comprising:
- a reflex sight, said reflex sight comprising:
- a housing mounted on said firearm, said housing defining a line of sight parallel to said firing axis;

a receptacle positioned within said housing underlying said line of sight, said receptacle having an opening facing said firearm;

a bottom plate covering at least a portion of said opening;

an optical element comprising a reflector attached to a base, said base being received within said receptacle such that said reflector intersects said line of sight.

* * * * *